US006371314B1

(12) United States Patent
Boisvert

(10) Patent No.: US 6,371,314 B1
(45) Date of Patent: Apr. 16, 2002

(54) HOISTING DEVICE FOR ALL TERRAIN VEHICLE

(76) Inventor: Patrick Boisvert, 9-C Principale, Stanstead, Quebec (CA), J0B 3E5

( * ) Notice: Subject to any disclaimer, the term of this patent is extended or adjusted under 35 U.S.C. 154(b) by 0 days.

(21) Appl. No.: 09/620,180

(22) Filed: Jul. 20, 2000

Related U.S. Application Data

(63) Continuation-in-part of application No. 09/332,339, filed on Jun. 14, 1999, now abandoned.

(30) Foreign Application Priority Data

Jun. 15, 1998 (GB) ..... 9812744

(51) Int. Cl.[7] ..... B66C 23/44
(52) U.S. Cl. ..... 212/180; 212/305; 212/901
(58) Field of Search ..... 212/179, 302, 212/303, 304, 305, 306, 901, 180

(56) References Cited

U.S. PATENT DOCUMENTS 2,298,199 A * 10/1942 Court et al. ..... 212/239
3,082,746 A * 3/1963 Kerridge ..... 212/293
3,374,901 A * 3/1968 Ferwerda ..... 212/180
3,826,334 A * 7/1974 Spillman ..... 182/2
3,980,276 A * 9/1976 Burkland ..... 254/139.1
4,150,754 A * 4/1979 Schmitt ..... 212/300
4,615,130 A * 10/1986 Racicit ..... 37/231
4,897,013 A * 1/1990 Thompson et al. ..... 414/703

FOREIGN PATENT DOCUMENTS

CA 752222 * 2/1967 ..... 212/301

* cited by examiner

*Primary Examiner*—Thomas J. Brahan
(74) *Attorney, Agent, or Firm*—Eric Fincham

(57) ABSTRACT

A combination of an all terrain vehicle and a hoisting device for use therewith, the all terrain vehicle including a frame, a body mounted on the frame and wheels, the hoisting device comprising a hoisting device frame having at least one member extending rearwardly therefrom for securement to the all terrain vehicle, a boom having first and second ends with the first end of the boom being secured to the hoisting device frame, the boom being capable of being raised and lowered, and a support platform located at the second end of the boom. The combination is useful in activities such as hedge maintenance, window washing, and the like. The arrangement is relatively inexpensive and may be used with any suitable ATV.

8 Claims, 3 Drawing Sheets

HOISTING DEVICE FOR ALL TERRAIN VEHICLE

The present application is a continuation-in-part of application Ser. No. 09/332,339 filed Jun. 14, 1999, now abandoned.

FIELD OF THE INVENTION

The present invention relates to a portable support boom for supporting a load and particularly to a boom which is adaptable to an all terrain vehicle (ATV).

BACKGROUND OF THE INVENTION

The use of all terrain vehicles has mushroomed in recent years. Generally, many such all terrain vehicles are used for recreational purposes. However, they have increasingly started to find usefulness as vehicles for accessing sites not readily accessible by conventional vehicles such as automobiles. Furthermore, they are increasingly used as utility vehicles by trades people.

Many jobs require that access be had to a location requiring the use of some lifting or hoisting device. Such jobs can include window washing, the picking of fruits such as oranges and apples, the trimming of trees and/or hedges, and/or general repair work around a building. To date, ladders and/or specialized cranes have been used for these purposes.

It would inherently be desirable if there were available a boom type arrangement which is relatively inexpensive and could be utilized with vehicles such as ATVs. Since ATVs are not nearly as expensive as other specialized vehicles, and due to their ready availability, a boom structure which could be used in conjunction with the ATV would find many uses.

Portable support booms for various purposes such as window washing have been known in the art. However, the problems of transport of the same and their stability has limited use of the same.

SUMMARY OF THE INVENTION

It is therefore an object of the present invention to provide a boom structure which may be used in conjunction with an all terrain vehicle.

According to one aspect of the present invention, there is provided, in combination, an all terrain vehicle which has a frame, a body mounted on the frame, and wheels, and a hoisting device, the hoisting device comprising a hoisting device frame, the hoisting device frame being mounted on first and second ground contacting wheels, first and second stabilizing members extending substantially horizontally outwardly from the hoisting device frame, a ground engaging wheel being mounted on each of the first and second stabilizing members proximate a distal end thereof, at least one attachment member extending rearwardly from the hoisting device frame, the attachment member being secured to an underside portion of the all terrain vehicle, a boom having first and second ends, the first end of the boom being secured to the hoisting device frame, means for raising and lowering the boom, and a device located proximate the second end of the boom. There is also provided means for vertically moving upwardly, with respect to the hoisting device frame, a proximal end of each of the stabilizing members extending from the frame such that the ground engaging wheels on the first and second stabilizing members will be forced into secured contact with the ground and the all terrain vehicle acts as a counterbalance for the boom.

In greater detail, the combination of the present invention may be used in conjunction with any suitable ATV. Many such makes of ATVs are available on the market. The present invention includes, as aforementioned, at least one member extending rearwardly from the hoisting device frame and which is preferably secured to an underside portion of the all terrain vehicle. While many means of securing the member to the all terrain vehicle can be used, it is preferred that there be at least a two point attachment. In a preferred embodiment of the present invention, there are provided a pair of members extending rearwardly from the hoisting device frame, with a first attachment means comprising a "hand" which is adapted to seat on a frame portion at one end of the vehicle, with a further attachment being located near the end of the longitudinally extending members. As each all terrain vehicle is different, there may be provided means for adaptors designed for each particular type. Needless to say, such adaptors can be readily removed from the longitudinally extending members such that different adaptors may be employed. Also, the hoisting device may be secured to a suitable portion of the ATV by winch straps and the like. Frequently, the ATV will have a suitable frame structure at the front of the vehicle.

The hoisting device includes suitable wheels for transporting the same. In one particular embodiment, there may be provided a pair of outwardly extending leg support members at the end of which are mounted pneumatic wheels. As mentioned above, a particularly preferred arrangement is one wherein the leg support members are pivotably connected and so may be independently operated for adjustment to uneven terrain.

The hoisting device may also include a pair of stabilizing members which carry wheels thereon and which extend laterally outwardly. Preferably, such members are retractable onto the frame of the hoisting device.

The boom itself may be either a single boom member or alternatively and preferably, is of a telescoping nature to provide for maximum flexibility. Suitable winch means to operate the telescoping boom may be provided.

At the distal end of the boom, there may be provided different attachments conventionally used with booms. For example, one could provide a hook or other type of clamping member depending upon the job for which the boom is employed. In a particularly preferred aspect of the present invention, there is provided a platform structure designed to accept a person thereon. This arrangement would thus allow the user to gain access to otherwise inaccessible spots.

The boom is also preferably rotatable about a central post so as to provide maximum flexibility and permit access to different locations without having to move the ATV and boom structure.

The various drive means utilized with the boom structure of the present invention may be any conventional. The boom structure may include a power means such as one or more batteries which then may drive electric winches and/or cylinders. Alternatively, one could use the power means of the ATV with suitable interfaces. Also, the use of hydraulically driven accessories may be incorporated in the practice of the present invention.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
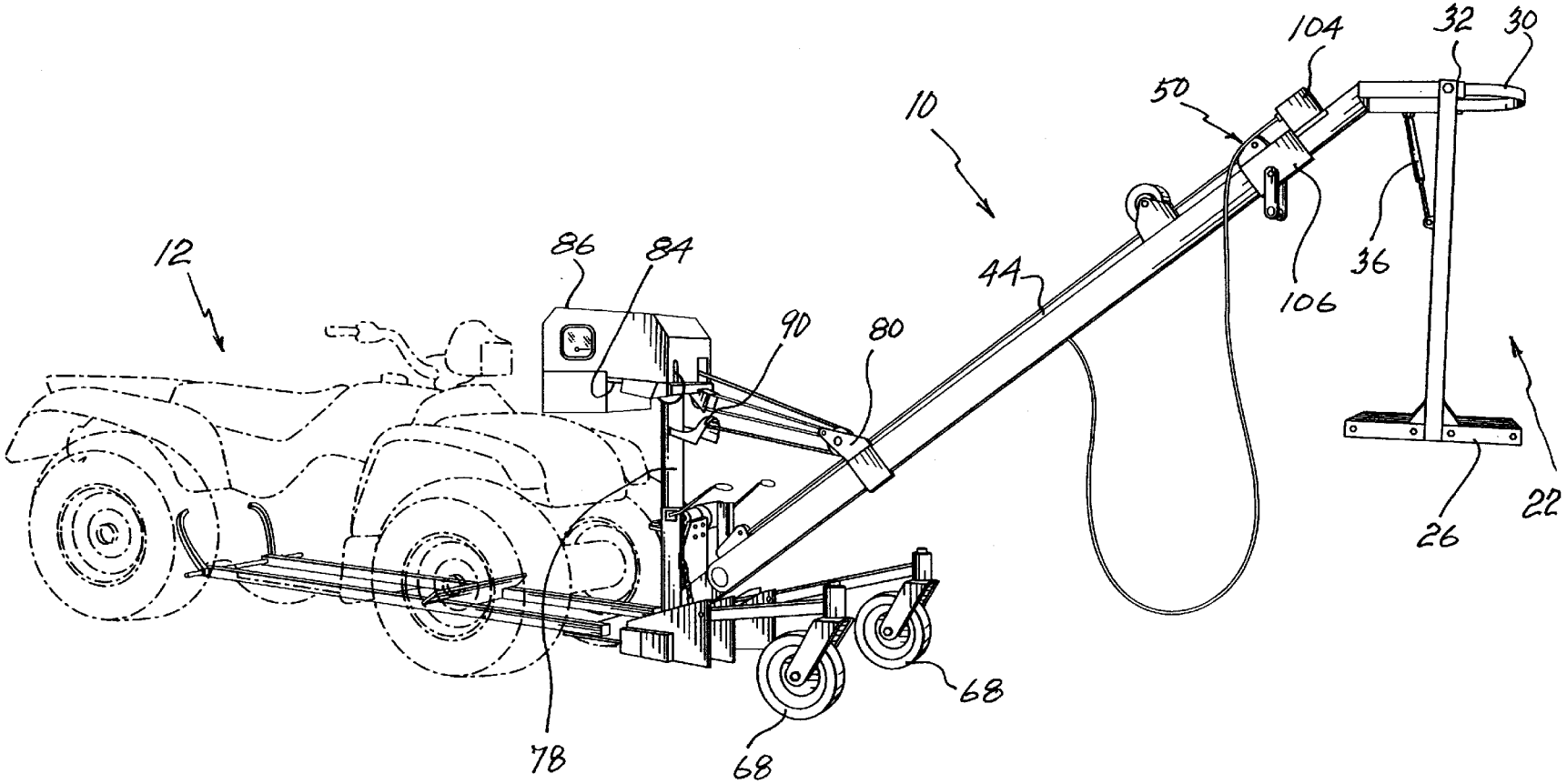
FIG. 1 is a perspective view of an all terrain vehicle and a hoisting device.

Referring to the drawings in greater detail and by reference characters thereto, there is illustrated in FIG. 1 a hoisting device generally designated by reference numeral 10 and which is designed to be used with an all terrain vehicle generally designated by reference numeral 12.

The hoisting device includes an attachment portion 14 for attaching hoisting device 10 to all terrain vehicle 12, a base portion 16, a boom structure 20, and a support platform generally designated by reference numeral 22.

Figure 2:
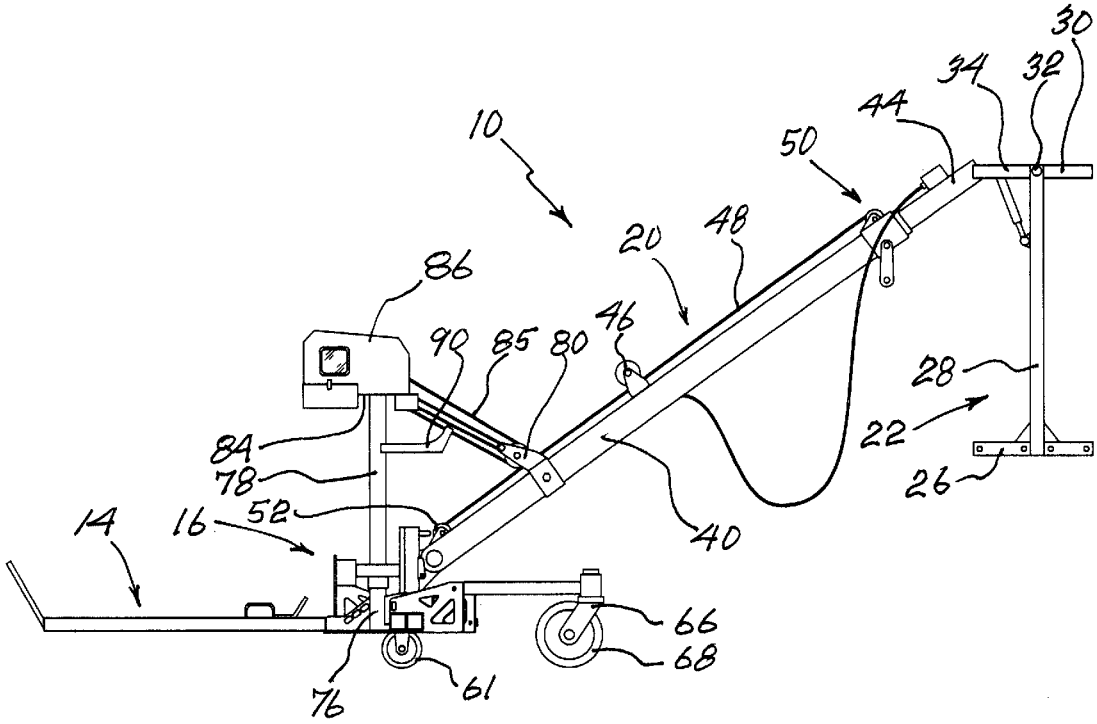
FIG. 2 is a side elevational view of a slightly modified version of the hoisting device shown in FIG. 1.

Support platform 22 is used to support a user although other structures or attachments may likewise be employed. Support platform 22 includes a mesh bottom 26 upon which the user can stand and a pair of structural posts 28 extending on either side thereof. A door arrangement 30' (FIGS. 2 and 3) or retaining member 30 (FIG. 1) is hingedly connected with respect to posts 28 and there may be a locking mechanism 32 associated therewith. Hydraulic cylinder 36 extends between an upper U-shaped member 34 and a side post 28 to adjust the angle of the support platform 22. Cylinder 36 can be locked in a desired position.

Boom structure 20 includes an outer boom member 40 which is pivotably connected at one end thereof by means of a bracket 42 to base portion 16 as will be described in greater detail hereinbelow. Mounted in a telescopic relationship with outer boom member 40 is an inner boom member 44. An electric winch 46 is mounted on outer boom member 40 and is designed to telescopically move inner boom member 44 with respect to outer boom member 40 by means of cable 48. In this respect, there are provided an upper pulley and bracket arrangement generally designated by reference numeral 50 and a lower pulley and bracket arrangement generally designated by reference numeral 52 for accepting cable 48.

As may be seen in FIG. 1, a hook member 54 is provided at the distal end of inner boom member 44. Hook member 54 may be utilized for securing a safety belt and/or securing tools.

As may be seen in FIG. 1, a further pulley support and bracket 56 is mounted on outer boom member 40 for reasons to be described hereinbelow.

Base portion 16 includes a base member or hoisting device frame 60. Extending diagonally outwardly from base member 60 are two pairs of support brackets 62 as may be best seen in FIGS. 3 and 4. A pair of jacks 70 having actuating handles 71 are mounted on base member 60 for reasons which will become apparent hereinbelow.

Extending outwardly from between each pair of support brackets 62 are stabilizing members 64. Stabilizing members 64 are pivotably connected to support brackets 62 for reasons discussed hereinbelow. At the distal end of each stabilizing member 64, there is provided a wheel mounting bracket 66, each wheel mounting bracket receiving a pneumatic wheel 68.

A jack 70 is associated with each stabilizing member 64. Each jack 70 has a bracket 75 mounted thereon and the upper portion 73 of each jack 70 is vertically moveable through actuating handle 71. In operation, a chain (not shown) extends between bracket 75 and an end of stabilizing member 64 such that vertical movement of upper portion 73 of jack 70 will cause a pivoting movement of stabilizing member 64 to adjust each wheel 68 to the particular terrain on which the device is placed.

Figure 3:
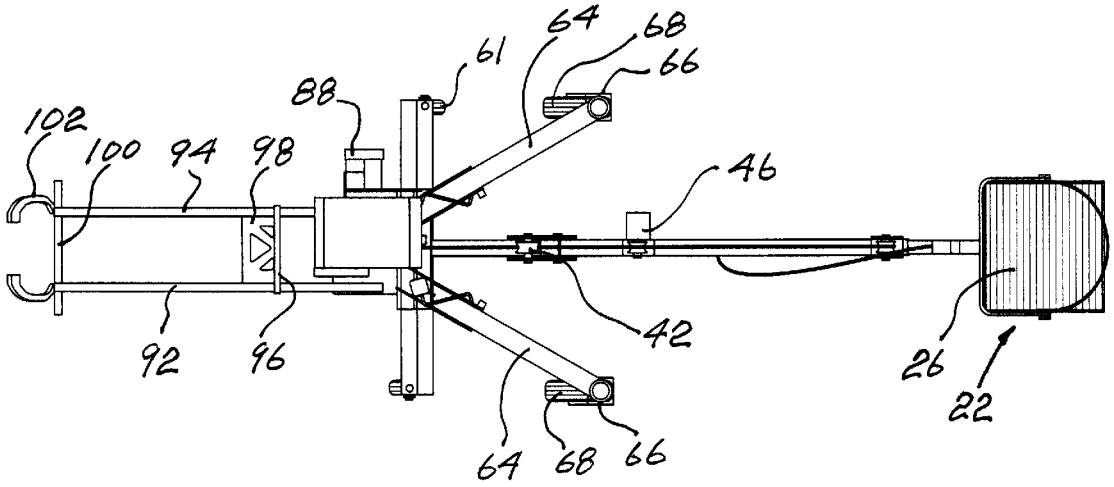
FIG. 3 is a top plan view of the hoisting device shown in FIG. 2.
Figure 4:
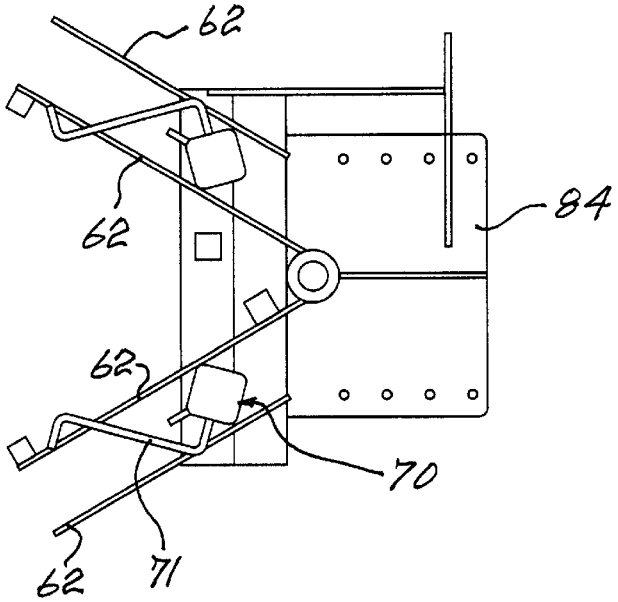
FIG. 4 is a top plan view of the base.
Figure 5:
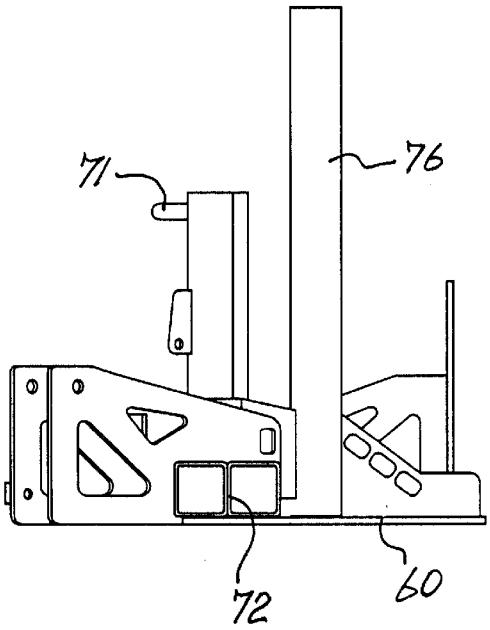
FIG. 5 is a side elevational view of the base platform and members mounted thereon.
Figure 6:
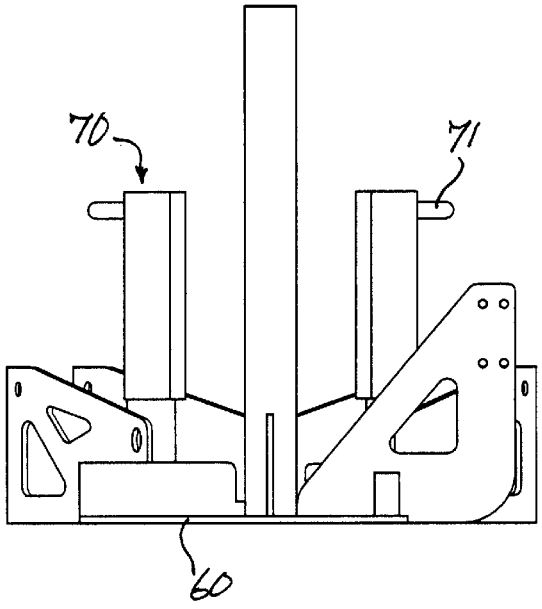
FIG. 6 is an end view of the base platform.

As may be best seen in FIG. 3, a pair of tubular members 72 are mounted on base member 60 and are designed to receive therein a second tubular member to which are mounted wheels 61. The second tubular members and wheels may be extended or retracted to function as stabilizers.

Also mounted on base member 60 is a lower post 76 which telescopically receives an upper post 78. Suitable bearing arrangements are provided interiorly thereof; upper post 78 is designed to rotate about lower post 76.

Mounted on upper post 78 is a winch 86 which is mounted on a winch base 84. Winch 86 is operatively connected by means of a winch cable 85 to a first winch bracket 80 mounted on outer boom member 40 and to a second winch cable attachment 90 mounted on post 78. Also provided is an electric cylinder 88 which is operatively connected to upper post 78 to turn the same. A retractable safety belt 93 of the automotive type connects post 78 and outer boom member 40 to prevent a sudden lowering of the boom.

Attachment portion 14 includes a pair of longitudinally extending rails 92 and 94, one end of which is secured to base member 60. A transverse cross member 96 is provided intermediate the ends of rails 92 and 94. Cross member 96 is adapted to receive a mounting member or hand 98 which is designed for the particular ATV. At the distal end of rails 92 and 94, there is provided a threaded rod 100 which is designed to removably receive frame clamps 102. Frame clamps 102 will again be customized for the particular ATV and are designed to grasp a portion of the frame at either the rear or front of the vehicle.

In operation, the all terrain vehicle 12 is placed in a desired position such that hand 98 and frame clamp 102 are located in the desired location with respect to the all terrain vehicle. Subsequently, connecting straps may be connected to a front frame F of the ATV. Jacks 70 may then be operated to ensure proper contact of wheels 68 with the terrain. The stabilizing members are also extended outwardly.

The boom structure may then be operated as desired and to this end, there is preferably provided a remote control member 104 which is mounted on mounting member 106 for controlling the different operations of the boom structure—i.e. the telescoping of the boom by means of winch 46, the lifting of the same by means of winch 86, and rotation by means of cylinder 88.

It will be understood that the above described embodiment is for purposes of illustration only and that changes and modifications may be made thereto without departing from the spirit and scope of the invention.

I claim:

1. In combination, an all terrain vehicle including a frame, a body mounted on said frame, and wheels, and a hoisting device, said hoisting device comprising:

a hoisting device frame;

said hoisting device frame being mounted on first and second ground contacting wheels;

first and second stabilizing members extending substantially horizontally outwardly from said hoisting device frame, a ground engaging wheel mounted on each of said first and second stabilizing members proximate a distal end thereof;

at least one attachment member having at least one grasping clamp extending rearwardly from said hoisting device frame for a distance sufficient to permit said grasping clamp to grasp a remote portion of said frame of said all terrain vehicle, said attachment member being secured to an underside portion of said all terrain vehicle;

a boom having first and second ends, said first end of said boom being secured to said hoisting device frame;

means for raising and lowering said boom;

a device located proximate said second end of said boom; and means for vertically moving upwardly, with respect to said hoisting device frame, a proximal end of each of said stabilizing members extending from said frame such that said ground engaging wheels on said first and second stabilizing members will be forced into secure contact with the ground and said all terrain vehicle acts as a counterbalance for said boom.

2. The combination of claim 1 wherein said device proximate said second end of said boom comprises a platform designed to receive a person thereon.

3. The combination of claim 2 further including means for adjusting the angular position of said platform, said means comprising an actuating cylinder mounted on said boom and connected to said platform.

4. The combination of claim 1 further including a post mounted on said frame, winch means mounted on said post, said winch means being operatively connected to said boom to thereby raise and lower said boom.

5. The combination of claim 4 wherein said post is rotatably mounted on said frame, and further including drive means for rotating said post to thereby rotatably move said boom.

6. The combination of claim 4 further including safety means interconnecting said boom and said post to prevent said boom from lowering suddenly.

7. The combination of claim 1 wherein said boom comprises a telescopic boom having at least first and second boom members telescopically mounted with respect to each other, and drive means for telescopically moving said first and second boom members.

8. The combination of claim 1 wherein said at least one member extending rearwardly from said hoisting device frame comprises a first connecting means adapted to connect proximate a front end of said all terrain vehicle and a second connecting means designed to connect proximate a rear end of said all terrain vehicle.

* * * * *